US011890500B2

(12) United States Patent
Tekerlek

(10) Patent No.: US 11,890,500 B2
(45) Date of Patent: Feb. 6, 2024

(54) FITNESS APPARATUS

(71) Applicant: Korkut Tekerlek, Winkel (CH)

(72) Inventor: Korkut Tekerlek, Winkel (CH)

( * ) Notice: Subject to any disclaimer, the term of this patent is extended or adjusted under 35 U.S.C. 154(b) by 262 days.

(21) Appl. No.: 17/297,418

(22) PCT Filed: Nov. 18, 2019

(86) PCT No.: PCT/EP2019/081656
§ 371 (c)(1),
(2) Date: May 26, 2021

(87) PCT Pub. No.: WO2020/109057
PCT Pub. Date: Jun. 4, 2020

(65) Prior Publication Data

US 2022/0008777 A1 Jan. 13, 2022

(30) Foreign Application Priority Data

Nov. 28, 2018 (CH) ..... 01466/18

(51) Int. Cl.
*A63B 21/00* (2006.01)
*A63B 22/00* (2006.01)
(Continued)

(52) U.S. Cl.
CPC ..... *A63B 21/4035* (2015.10); *A63B 21/0023* (2013.01); *A63B 21/0058* (2013.01);
(Continued)

(58) Field of Classification Search
CPC ..... A63B 21/4035; A63B 21/00196; A63B 21/0023; A63B 21/4034; A63B 22/0005;
(Continued)

(56) References Cited

U.S. PATENT DOCUMENTS 5,044,355 A * 9/1991 Reopelle ..... A63B 23/0417 482/131
5,181,894 A * 1/1993 Shieng ..... A63B 22/0012 482/118

(Continued)

FOREIGN PATENT DOCUMENTS

CN 107708815 A 2/2018
DE 202015102636 U1 6/2015

(Continued)

OTHER PUBLICATIONS

China National Intellectual Property Administration, Office Action, CN Application No. 201980088832.4, dated Mar. 11, 2022, 10 pages.
PCT International Search Report and Written Opinion, Application No. PCT/EP2019/081656, dated Jan. 17, 2020, 11 pages.

*Primary Examiner* — Joshua Lee
*Assistant Examiner* — Catrina A Letterman
(74) *Attorney, Agent, or Firm* — Mahamedi IP Law LLP

(57) ABSTRACT

The present application relates to a fitness apparatus having a housing on which are arranged a first supporting element and also a second supporting element. The first and the second supporting elements can be moved linearly in each case in two spatial dimensions located at right angles to one another. The housing has at least one active element, by means of which a movement of the first supporting element or of the second supporting element out of a respective starting position is counteracted by a force. The housing also has at least one coupling element, which couples the linear movement of the first supporting element in a first direction of a first of the two spatial dimensions to a linear movement of the second supporting element in the second direction, which opposes the first direction in this first of the two spatial dimensions.

8 Claims, 4 Drawing Sheets

(51) Int. Cl.
*A63B 21/002* (2006.01)
*A63B 22/20* (2006.01)
*A63B 21/005* (2006.01)

(52) U.S. Cl.
CPC .... *A63B 21/00196* (2013.01); *A63B 21/4034* (2015.10); *A63B 22/0005* (2015.10); *A63B 22/0007* (2013.01); *A63B 22/0012* (2013.01); *A63B 22/208* (2013.01); *A63B 2220/51* (2013.01); *A63B 2225/093* (2013.01); *A63B 2225/10* (2013.01)

(58) Field of Classification Search
CPC ..... A63B 22/0007; A63B 2220/51; A63B 2225/093; A63B 2225/10; A63B 21/025; A63B 21/0428; A63B 21/068; A63B 2208/12; A63B 2210/06; A63B 21/157; A63B 21/4045; A63B 2225/09; A63B 22/203; A63B 21/00185; A63B 21/002; A63B 21/005; A63B 21/0058–0059; A63B 21/008–0083; A63B 21/0085–0087; A63B 21/02; A63B 21/022; A63B 21/023; A63B 21/05–0552; A63B 21/151; A63B 21/4033–4035; A63B 22/0002–0012; A63B 22/0076–0089; A63B 22/20–208; A63B 2022/0028–0035
See application file for complete search history.

(56) References Cited

U.S. PATENT DOCUMENTS

| | | | | |
|---|---|---|---|---|
| 5,803,880 | A * | 9/1998 | Allen | A63B 21/0087 482/37 |
| 6,514,180 | B1 * | 2/2003 | Rawls | A63B 21/005 482/70 |
| 9,011,296 | B2 * | 4/2015 | Peralo | A63B 23/03575 482/123 |
| 9,022,909 | B2 * | 5/2015 | Kermath | A63B 21/0428 482/133 |
| 2004/0204293 | A1 * | 10/2004 | Andreasen | A61H 1/0262 482/52 |
| 2009/0298655 | A1 * | 12/2009 | Lacher | A63B 22/203 482/134 |
| 2013/0017934 | A1 * | 1/2013 | Tayebi | A63B 21/4045 482/129 |
| 2016/0317863 | A1 * | 11/2016 | Goldberg | A63B 22/14 |
| 2017/0113094 | A1 * | 4/2017 | Bailar | A63B 22/203 |
| 2021/0220696 | A1 * | 7/2021 | Carruthers | A63B 21/4045 |
| 2022/0370854 | A1 * | 11/2022 | Zhang | A63B 21/4035 |

FOREIGN PATENT DOCUMENTS

| | | | |
|---|---|---|---|
| DE | 102016106902 | A1 | 11/2016 |
| WO | 2015106227 | A1 | 7/2015 |

* cited by examiner

FITNESS APPARATUS

TECHNICAL FIELD

The invention relates to a fitness apparatus having two limb-supporting elements, wherein the two supporting elements can be moved in a coordinated manner in relation to one another in two spatial dimensions. The present invention also relates to an arrangement made up of two such fitness apparatuses, for training four limbs.

PRIOR ART

A large number of fitness apparatuses are disclosed in the prior art.

Fitness apparatuses for training the leg muscles or the arm muscles are usually relatively large and bulky. In particular, fitness apparatuses which can be used to train both the leg muscles and the arm muscles, due to their weight and their size, are usually suitable only for stationary use.

DESCRIPTION OF THE INVENTION

The object of the invention is to provide a fitness apparatus which belongs to the technical field mentioned in the introduction and has as compact and straightforward a construction as possible, but nevertheless allows isometric training of muscle groups in legs or arms as efficiently as possible.

The way in which the object is achieved is defined by the features of claim 1. According to the invention, the fitness apparatus has a housing on which are arranged a first supporting element and also a second supporting element, which can each be moved linearly in two spatial dimensions located at right angles to one another. The housing has at least one active element, by means of which a movement of the first supporting element or of the second supporting element out of a respective starting position is opposed by a force. The housing also has at least one coupling element, which couples the linear movement of the first supporting element in a first direction of a first of the two spatial dimensions to a linear movement of the second supporting element in a second direction, which is opposed to the first direction in the first spatial dimension.

Coupling the movement of the first supporting element to a movement of the second supporting element is a straightforward way of achieving isometric training, for example of the muscles of both legs of a person using the fitness apparatus according to the invention.

The housing is preferably manufactured from a strong, resistant material. The housing preferably consists of a metal or an alloy, in particular steel, stainless steel or aluminum. As an alternative, however, it is also possible for the housing to be manufactured from a polymer material, for example acrylonitrile-butadiene-styrene copolymer (ABS). The housing is preferably cuboidal, in particular with rounded corners. As an alternative, however, it is also possible for the housing to be in the form of a truncated cylinder.

The first and the second supporting elements are preferably dimensioned such that a foot or part of an arm can be supported thereon. The surface of the supporting elements is preferably provided with a structure which increases the friction of the surface, for example by a grip tape being arranged on the surface.

The supporting elements are preferably rectangular. As an alternative, however, it is also possible for the supporting elements to be oval, round or polygonal. The supporting elements are preferably manufactured from a metal, a metal alloy or a polymer material.

The two supporting elements are preferably each arranged on at least one bearing, which allows the two supporting elements to move into the first and/or into the second spatial dimension. The bearing used can be, for example, a sliding bearing or a roller bearing.

Each of the two supporting elements has a starting position, that is to say a rest position. It is preferably the case that, in the starting position, the two supporting elements coincide with each other in the first spatial dimension, whereas the two supporting elements are spaced apart from one another in the second spatial dimension. The at least one active element counteracts any movement of the first or of the second supporting element out of the respective starting position. This means that the at least one active element pulls or pushes the first or the second supporting element back into the starting position. Since the movement of the first supporting element is coupled to the movement of the second supporting element, the force of the at least one active element is also transmitted to the respective other supporting element simultaneously via the coupling element.

The active element used is preferably an element made of a material with elastic properties. For example, the at least one active element can be a rope or cable, a band or a piece of elastomer or of rubber material. As an alternative, however, it is also possible for the at least one active element to be configured in the form of a pneumatic cylinder. Furthermore, the at least one active element can also comprise magnets which repel one another. The magnets used can be permanent magnets and also electric magnets, the latter having the advantage that the repulsion force can be influenced by virtue of the current which flows through the electromagnets being varied.

However, the at least one active element is preferably at least one spring. The at least one spring can be a tension spring or compression spring. The at least one spring is preferably configured in the form of a helical spring. However, the at least one spring can also be configured in the form of a leg spring or cup spring. In a further embodiment, however, it is also possible for the at least one spring to be configured in the form of an air spring or gas-pressure spring.

The at least one spring can be configured in the form of a tension spring or of a compression spring. The housing preferably has a plurality of active elements, by means of which a movement of the first or second supporting element out of the respective starting position is opposed by a force. The active elements are preferably arranged such that a movement of the first or second supporting element into both spatial dimensions is opposed by a force.

By means of the coupling element, a linear movement of the first supporting element, this movement being generated by a person using the fitness apparatus moving a part of the arm or foot which is supported thereon, is transmitted to the second supporting element, wherein the movement of the second supporting element in the corresponding spatial dimension takes place in a direction which opposes the movement of the first supporting element. This coupling means that the two supporting elements cannot move independently of one another. Isometric training is thus made possible.

If the fitness apparatus is designed for training the leg muscles, the housing has a bearing surface, by means of which it can be placed in position on a floor. In this case, the housing is preferably configured such that the first spatial dimension and also the second spatial dimension are oriented parallel to the floor surface. Such a fitness apparatus can be used, for example, beneath a desk so that the user, although seated, can nevertheless train the leg muscles.

However, the fitness apparatus can also be used for training the arm muscles, wherein the housing is positioned, for example, on a table or can be connected to a stand, which is in particular height-adjustable. The housing here can have two placement surfaces on two mutually opposite edges, these placement surfaces projecting from that side of the housing which is directed away from the two bearing surfaces. This allows the fitness apparatus to be supported on a bed to the side of a user lying in the bed. The fitness apparatus can thus be used for training the arm muscles of bedridden patients. Furthermore, it is also possible for the housing to have fastening elements for fastening the fitness apparatus on a wheelchair, so that a patient sitting in the wheelchair can easily train the arm muscles.

The housing can preferably have at least one vibration unit, by means of which the first supporting element and/or the second supporting element can be made to vibrate. The fitness apparatus can thus make use, in addition, of the advantages of vibration training.

The supporting elements are preferably guided in the first and/or in the second spatial dimension by means of at least one linear guide. The linear guide used can be, for example, at least one linear-guide bushing or a roller guide, which runs on a rail or in a profile rail.

The two supporting elements are preferably guided in the first and/or in the second spatial dimension by the same at least one linear guide. As an alternative, however, it is possible for each supporting element to be guided by at least one respective linear guide.

The at least one linear guide preferably has at least one stopper, which limits the movement of the supporting elements in the first and/or the second spatial dimension. This means that the at least one stopper can be used to define a maximum movement of the supporting elements out of the rest position in the respective spatial dimension in which the linear guide extends.

The housing preferably has at least one first linear guide, which extends in the first spatial dimension, wherein a carriage is arranged in a movable manner on this at least one first linear guide. This carriage has arranged on it at least one second linear guide, which extends in the second spatial dimension. The two supporting elements are arranged in a movable manner on this at least one second linear guide.

This embodiment is of relatively straightforward construction, robust and low-maintenance. However, it allows the two supporting elements to be moved linearly in the two spatial dimensions. It is also readily possible here for the supporting elements to move simultaneously, for example in a circulating manner, in the two spatial dimensions.

The at least one coupling element preferably comprises a first gearwheel, which is arranged essentially centrally on the surface area of the housing and of which the axis of rotation is located at right angles to the first spatial dimension and to the second spatial dimension. A first rack and a second rack engage with the first gearwheel on opposite sides of the latter. The first rack is fastened to the first supporting element and the second rack is fastened to the second supporting element. The first rack and the second rack extend in the direction of the first spatial dimension.

This makes it possible, using straightforward, but robust and low-maintenance means, to couple the linear movement of the first supporting element to the movement of the second supporting element in the first spatial dimension.

The gearwheel is preferably a spur gear, in particular preferably with an axis-parallel toothing formation. The engagement of the first or of the second rack in the toothing formation of the first gearwheel result in a respective rack-and-pinion mechanism being formed between the first rack or the second rack and the first gearwheel. Since the two racks are located on opposite sides of the first gearwheel, the racks move in opposite directions in the first spatial dimension when the first gearwheel rotates.

The housing preferably comprises a second coupling element, which has a second gearwheel, which is arranged essentially centrally on the surface area of the housing and of which the axis of rotation is located at right angles to the first spatial dimension and to the second spatial dimension. The second gearwheel is arranged above or beneath the first gearwheel. A third rack and a fourth rack engage with the second gearwheel on opposite sides of the latter, wherein the third rack is fastened to the first supporting element and the fourth rack is fastened to the second supporting element. The third rack and the fourth rack extend in the direction of the second spatial dimension.

The axes of rotation of the first and of the second gearwheels are preferably identical, that is to say the two gearwheels are located congruently one above the other.

The term "opposite" in the present application is understood to mean an arrangement in which the racks engage with the first or second gearwheel at positions which are offset through 180° in relation to one another on the first or second gearwheel.

The at least one active element is preferably configured such that the force thereof which counteracts a movement of the first supporting element or of the second supporting element out of the starting position acts on the first gearwheel and/or on the second gearwheel.

This makes possible a particularly compact, low-maintenance construction of the fitness apparatus according to the invention. In the case of this embodiment, the active element can be configured, for example, in the form of a torsion spring, in particular in the form of a leg spring.

In a further preferred embodiment, the at least one active element can be configured in the form of an electric motor or in the form of an electromechanical drive. This allows dynamic adjustment of the force which counteracts a movement of the first or of the second supporting element out of the starting position, wherein it is also possible for this force to be varied over the duration of a training session.

An electric motor or an electromechanical drive is particularly preferably used when the force acts on the first and/or on the second gearwheel. In this case, the axis of rotation of the first or of the second gearwheel can be formed by the shaft of the electric motor.

In the present application, an electromechanical drive is understood to mean a combination of an electric motor and gear mechanism. The gear mechanism preferably has a step-down or step-up transmission.

In a further preferred embodiment, the fitness apparatus has, both for the first supporting element and for the second supporting element, a respective electric motor or electromechanically drive, by means of which a movement of the respective supporting element out of the starting position is in each case counteracted by a force, wherein the fitness apparatus also has a control device which performs the function of the at least one coupling element by activating the electric motors or electromechanical drives such that the linear movement of the first supporting element in a first direction of a first of the two spatial dimensions couples to a linear movement of the second supporting element in a second direction, which opposes the first direction in this first of the two spatial dimensions.

It is preferably possible to adjust the force of the at least one active element which counteracts a movement of the first supporting element or of the second supporting element out of the starting position.

If the at least one active element used is a spring, the force can be adjusted by virtue of the prestressing force of the spring being adjusted. This is achieved, for example, in that, in the starting position of the supporting elements, the length of the spring can be adjusted by an adjustment screw, wherein the adjustment screw can be used to displace a fastening point of the spring linearly along the longitudinal axis of the spring. If the at least one active element used is a pneumatic cylinder, the force can be adjusted by virtue of the air pressure within the pneumatic cylinder being varied.

The housing preferably has at least one sensor for monitoring the movement of the first and/or of the second supporting element. The at least one sensor here can be an optoelectronic sensor, for example a light barrier. As an alternative, however, it is also possible for the at least one sensor to be configured in the form of an acoustic sensor, in particular an ultrasonic transducer with a corresponding receiver. Furthermore, the at least one sensor can also be configured in the form of an acceleration sensor. As an alternative, the housing has at least one sensor which is used to measure the force which acts on the first supporting element and/or on the second supporting element.

The at least one sensor is preferably used to measure the movement speed, the position and/or the acceleration of the first and/or of the second supporting element. The fitness apparatus preferably has a control device which can evaluate the data from the at least one sensor. The control device here is preferably configured such that, on the basis of the data measured by the at least one sensor, a person using the fitness apparatus can thereby be shown information by at least one display, for example an LCD screen. On the basis of the data from the at least one sensor, the control device preferably alters the force which counteracts the movement of the first or second supporting element out of the starting position, in particular so that the speed and/or acceleration measured for the first or second supporting element by the at least one sensor lies in a set-point range. This set-point range is preferably stored in the control device and corresponds to a range of values which makes optimum muscle training possible.

The at least one display preferably shows a position which has to be assumed by a user on the fitness apparatus. On the basis of the data from the at least one sensor, the control device checks whether the user has assumed the position shown. It is possible here for the control device to assess the user, or award him/her a number of points, for example on the basis of the number of different positions assumed during a certain period of time. The play instinct can urge on the user and motivate him/her to train.

The two supporting elements preferably each have a handle, which extends in a third spatial dimension, which is located at right angles to the first spatial dimension and to the second spatial dimension. This also allows the two supporting elements to be gripped by hand.

The handle preferably has a first part and a second part, wherein the first part can be displaced linearly relative to the second part in the third spatial dimension. Displacement of the first part relative to the second part takes place counter to a spring force. This means that the arm muscles, in addition to the movements in the first and the second spatial dimensions, can also be trained by means of movements in the third spatial dimension.

The spring force is preferably generated by a combination made up of a tension spring and a compression spring, and therefore, when the first part moves linearly relative to the second part of the handle in both directions, a spring force counteracts the movement.

The fitness apparatus can preferably have at least one second coupling element, which couples a movement of the first part of the handle of the first supporting element to a movement of the first part of the handle of the second supporting element. The coupling here can take place such that the first parts moves in the same direction, or in opposing directions, in the third spatial dimension.

The present application also relates to an arrangement made up of two fitness apparatuses according to the description above. The housing of a first of the two fitness apparatuses is configured for placing on a floor, wherein the supporting elements of the housing are suitable for having feet placed in position on them. The first spatial dimension and also the second spatial dimension are oriented essentially parallel to the floor. A second fitness apparatus is connected in a releasable manner to the first fitness apparatus, and are spaced apart therefrom by a first distance, via an upright, which extends essentially in a third spatial dimension, which is located at right angles to the first spatial dimension and to the second spatial dimension.

Such an arrangement makes it possible for a user to train a large number of muscle groups at the same time. Since both the arms and legs are supported in a movable manner, a movement for example of the arms automatically gives rise as well to a countermovement of the legs, since otherwise balance would be lost. Accordingly, more muscle groups than just the leg and arm muscles are trained. To form a releasable connection, the housing of the first fitness apparatus and also the upright have complementary elements of a quick-release fastener.

It is preferably possible to alter the first distance via an adjustment mechanism of the upright, in particular with a quick-release fastener. This allows the arrangement to be used by users of different heights. As an alternative, however, it is also possible for the adjustment mechanism to have an electromechanical drive, by means of which the first distance can be altered automatically, for example at the push of a button.

The further advantageous embodiments and combinations of features of the invention can be gathered from the following detailed description and from the patent claims taken collectively.

BRIEF DESCRIPTION OF THE DRAWINGS

In the drawings used for the purpose of explaining the exemplary embodiment.

In principle, identical parts are provided with identical reference signs in the figures.

WAYS OF IMPLEMENTING THE INVENTION

Figure 1:
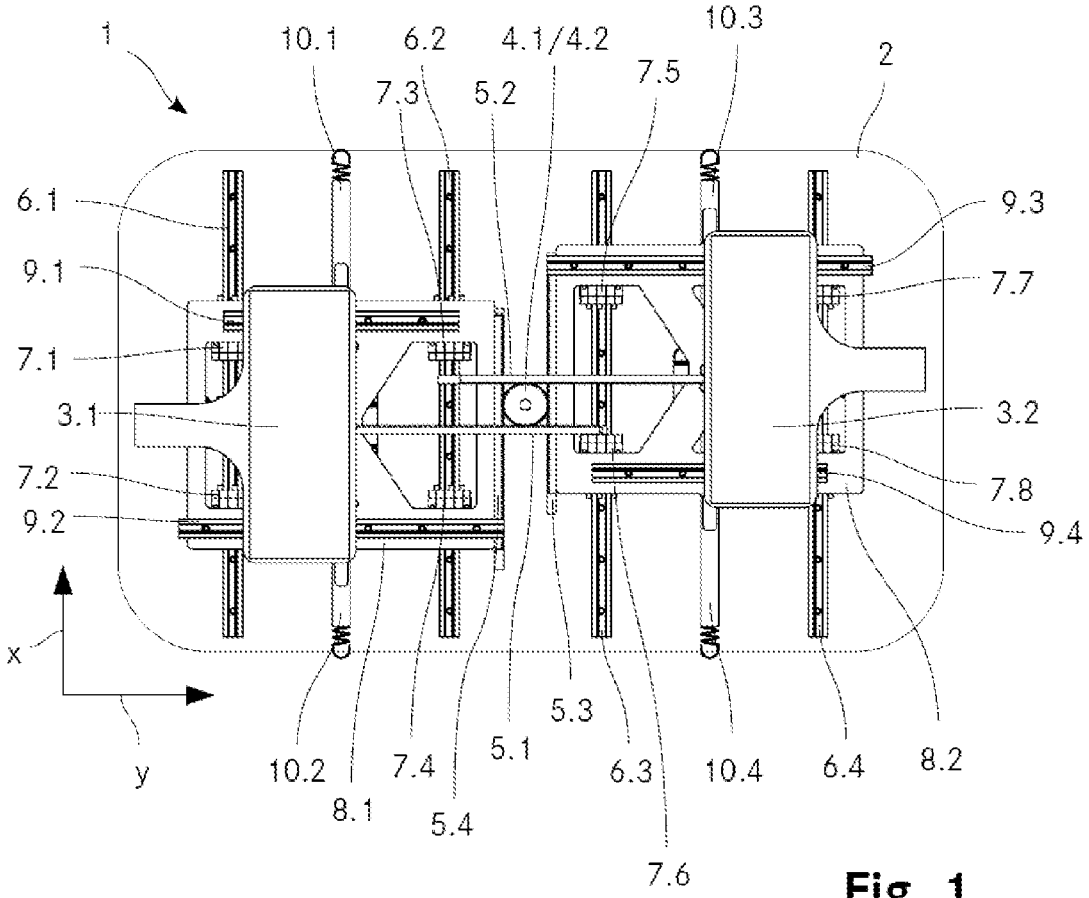
FIG. 1 shows a plan view of a first embodiment of a fitness apparatus according to the invention.
Figure 2:
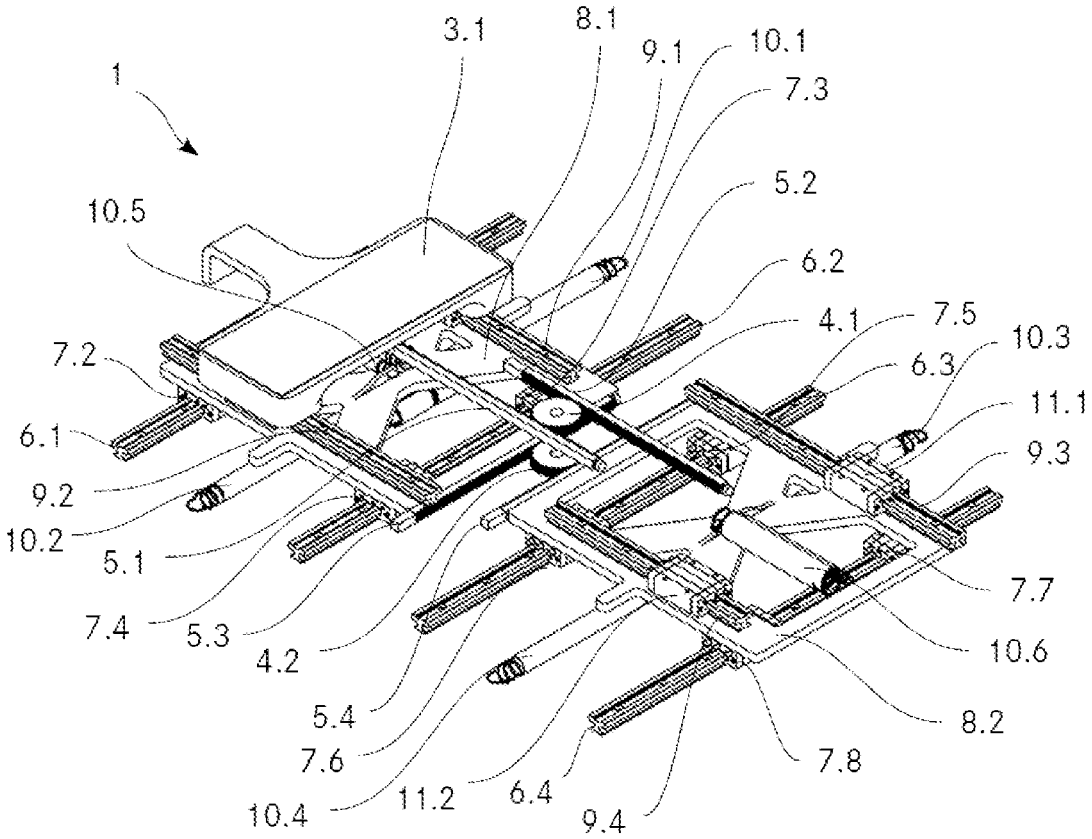
FIG. 2 shows an isometric view of the embodiment according to FIG. 1.

FIG. 1 shows a plan view of a first embodiment of a fitness apparatus 1 according to the invention, while FIG. 2 illustrates an isometric view of the same embodiment of the fitness apparatus 1. The fitness apparatus 1 has a frame 2 (not shown in FIG. 2, for illustrative reasons). A first supporting element 3.1 and also a second supporting element 3.2 (not shown in FIG. 2, for illustrative reasons) are arranged on the frame 2. The two supporting elements 3.1, 3.2 can be moved in two spatial dimensions x, y on the frame 2. This movement is made possible by a combination of a first linear guide, which extends in the first spatial dimension x, and of a second linear guide, which extends in the second spatial dimension y.

The first linear guide has four rails 6.1-6.4, which extend in the first spatial dimension x. Two carriages 8.1, 8.2 are arranged in a linearly displaceable manner on the four rails 6.1-6.4 of the first linear guide. A first carriage 8.1 is mounted in a displaceable manner on the first rail 6.1 and on the second rail 6.2 of the first linear guide by means of a first, second, third and fourth roller guide 7.1-7.4. A second carriage 8.2 is mounted in a displaceable manner on the third rail 6.3 and on the fourth rail 6.4 by means of a fifth, sixth, seventh and eighth roller guide 7.5-7.8.

The two carriages 8.1, 8.2 have located on them a second linear guide, which extends in the second spatial dimension y and on which the two supporting elements 3.1, 3.2 are arranged in a linearly displaceable manner. In a manner analogous to the first linear guide, the second linear guide comprises four rails 9.1-9.4, which extend in the direction of the second spatial dimension y. A first rail 9.1 and also a second rail 9.2 of the second linear guide are arranged on the first carriage 8.1. The first supporting element 3.1 is arranged in a linearly displaceable manner on the first rail 9.1 and also the second rail 9.2 of the second linear guide via four roller guides (not shown). A third rail 9.3 and also a fourth rail 9.4 of the second linear guide are arranged on the second carriage 8.2. The second supporting element 3.2 is arranged in a linearly displaceable manner on the third rail 9.3 and also the fourth rail 9.4 of the second linear guide via four roller guides (not shown).

Four springs 10.1-10.4 serve as a first active element, by means of which a movement of the first supporting element 8.1 or of the second supporting element 8.2 out of a rest position is opposed by a force. A first spring 10.1 and also a second spring 10.2 of the first active element are connected to the housing 2 and also to the first carriage 8.1, wherein the first spring 10.1 and the second spring 10.2 extend in the direction of the first spatial dimension x. A third spring 10.3 and also a fourth spring 10.4 of the first active element are connected to the housing 2 and also to the second carriage 8.2, wherein the third spring 10.3 and the fourth spring 10.4 extend in the direction of the first spatial dimension x.

The fitness apparatus 1 also has a second active element, by means of which a movement of the two supporting elements 3.1, 3.2 out of the starting position in the direction of the second spatial dimension y is opposed by a force. This second active element likewise has springs, which are connected to the first carriage 8.1 or the second carriage 8.2 and to the first supporting element 3.1 or the second supporting element 3.2. These springs cannot be seen on the plan view shown in FIG. 1, since they are located beneath the supporting elements 3.1, 3.2. The fifth spring 10.5 and sixth spring 10.6, which belong to the second active element, can be seen in FIG. 2.

The fitness apparatus also has two coupling elements, which couples a movement of the first supporting element 3.1 in a first direction in the first spatial dimension or in the second spatial dimension y to a movement of the second supporting element 3.2 in a second direction, which opposes the first direction.

A first coupling element couples the movement of the first supporting element 3.1 to the movement of the second supporting element 3.2 in the first spatial dimension x. This first coupling element has a first gearwheel 4.1, which is located essentially centrally on the surface area of the housing 2. The axis of rotation of the first gearwheel 4.1 is located a right angles to the first spatial dimension x and to the second spatial dimension y. A first rack 5.1 and also a second rack 5.2 engage in the toothing formation of the first gearwheel 4.1. The first rack 5.1 is connected to the first carriage 8.1, whereas the second rack 5.2 is connected to the second carriage 8.2. The first rack 5.1 and the second rack 5.2 here engage in the first gearwheel 4.1 at an angle of 180° in relation to one another in the circumferential direction, wherein they are oriented parallel to the first spatial dimension x.

A second coupling element couples the movement of the first supporting element 3.1 to the movement of the second supporting element 3.2 in the second spatial dimension y. This second coupling element has a second gearwheel 4.2, which is located essentially centrally on the surface area of the housing 2. The axis of rotation of the second gearwheel 4.2 is located at right angles to the first spatial dimension x and to the second spatial dimension y. The second gearwheel 4.2 is arranged above the first gearwheel 4.1. A third rack 5.3 and also a fourth rack 5.4 engage in the toothing formation of the second gearwheel 4.2. The third rack 5.3 is connected to the first carriage 8.1, whereas the fourth rack 5.4 is connected to the second carriage 8.2. The third rack 5.3 and the fourth rack 5.4 here engage in the second gearwheel 4.2 at an angle of 180° in relation to one another in the circumferential direction, wherein they are oriented parallel to the second spatial dimension y.

Figure 3:
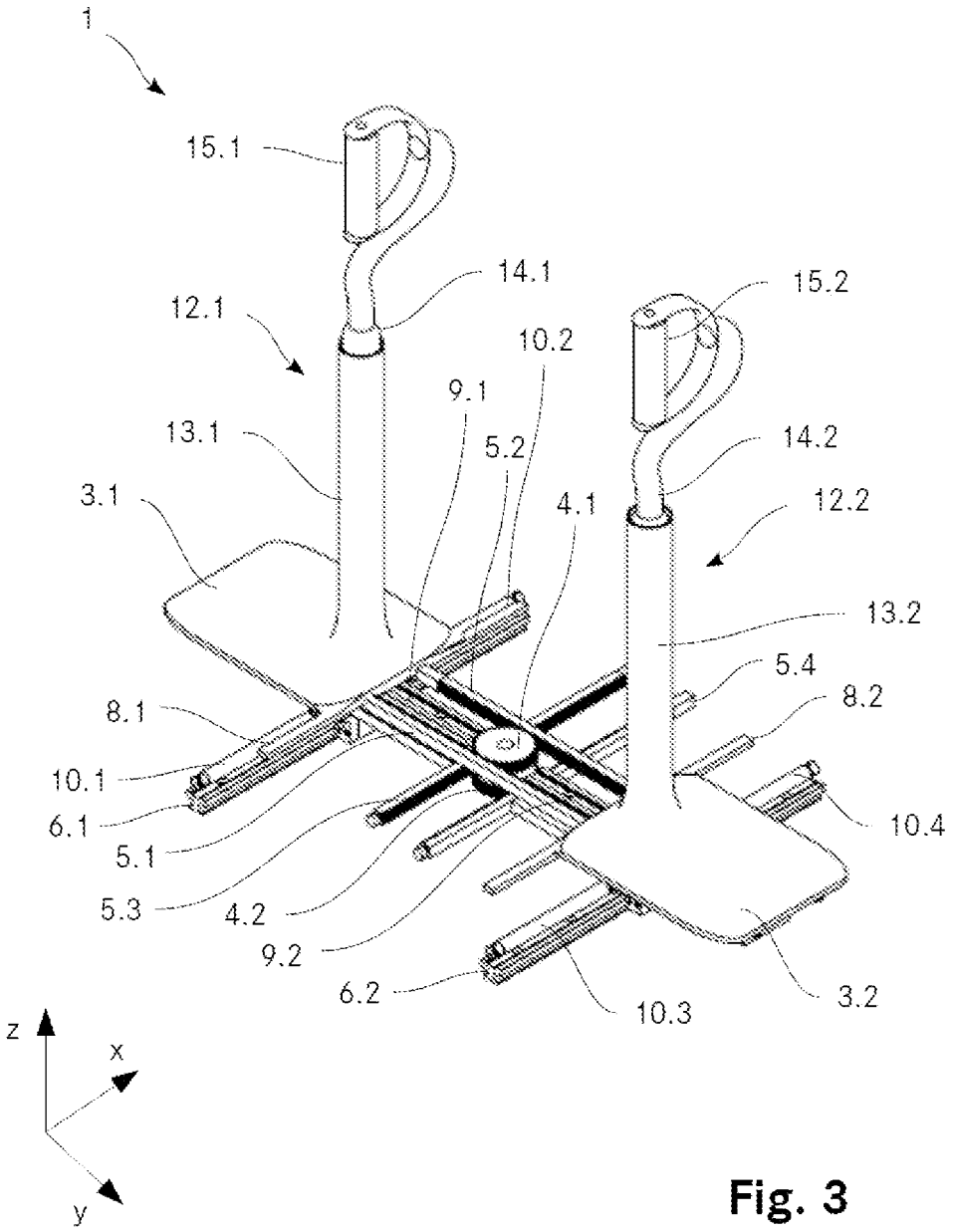
FIG. 3 shows a second embodiment of a fitness apparatus according to the invention.

FIG. 3 shows a second embodiment of a fitness apparatus 1 according to the invention. The fitness apparatus 1 of this embodiment is constructed essentially in the same way as the embodiment shown in FIGS. 1 and 2. However, in the case of this embodiment, the first and the second linear guides each have only two rails 6.1, 6.2, 9.1, 9.2. In addition, the supporting elements 3.1, 3.2 each have a handle 12.1, 12.2. The handles project from the supporting elements in a third spatial dimension z, which is located at right angles to the first spatial dimension x and to the second spatial dimension y. A person using the fitness apparatus 1 can grip the handles 12.1, 12.2 by hand, whereby effective isometric training of the arm muscles is made possible.

The handles 12.1, 12.2 each have a first part 13.1, 13.2, which is connected to the respective supporting element 3.1, 3.2. A second part 14.1, 14.2 of the handles 12.1, 12.2 is connected to the respective first part 13.1, 13.2 in a linearly movable manner in the third spatial dimension z. The second part 14.1, 14.2 of each handle 12.1, 12.2 can be displaced counter to a spring force in the third spatial dimension z. This means that training of the arm muscles in all three spatial dimensions is made possible by the embodiment of the fitness apparatus 1 according to the invention which is shown in FIG. 3. The spring force can be generated by a respective tension spring and compression spring being arranged within the first parts 13.1, 13.2 of the handles 12.1, 12.2. These springs generate a force which opposes a movement of the respective second part out of a starting position. It is also the case that a holding loop 15.1, 15.2 is fitted on the second part 14.1, 14.2 of each handle 12.1, 12.2, said loop making it easier for a user to hold the handles 12.1, 12.2.

Figure 4:
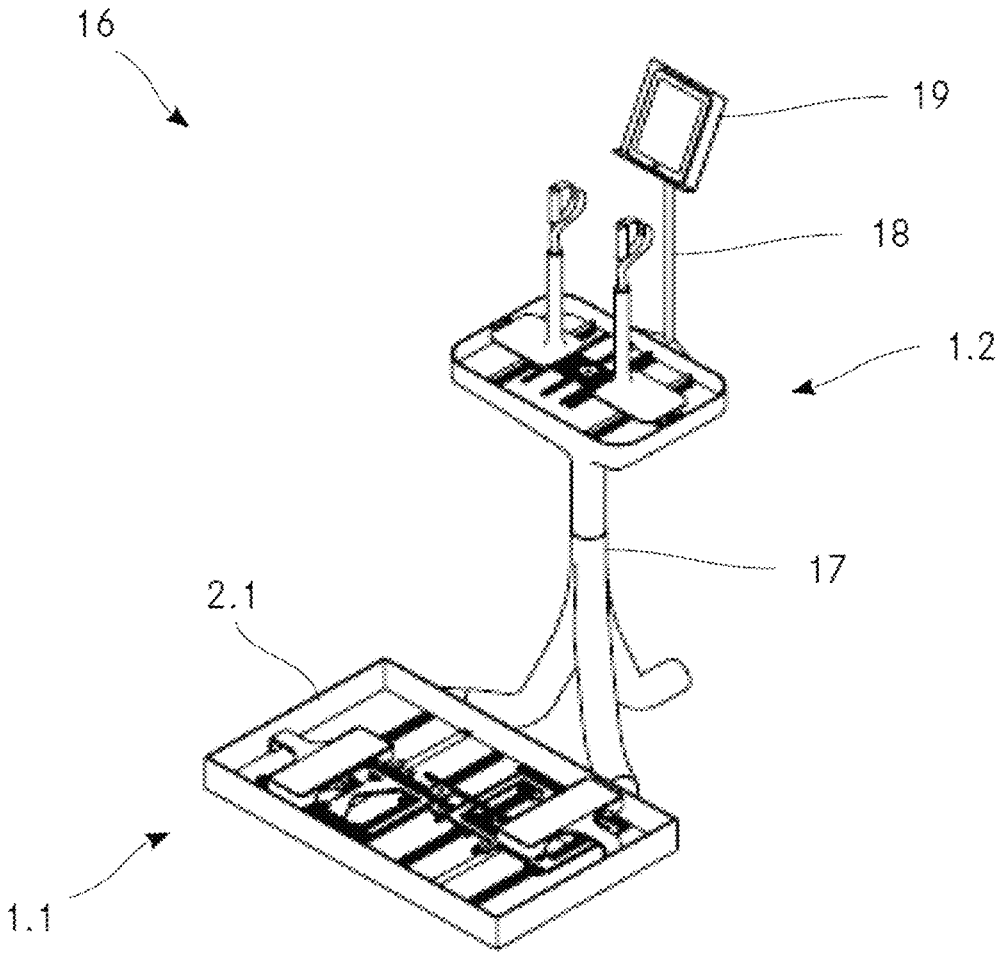
FIG. 4 shows an arrangement made up of two fitness apparatuses according to the invention.

FIG. 4 shows an arrangement 16 made up of two fitness apparatuses 1.1, 1.2 according to the invention. A first fitness apparatus 1.1 has a first frame 2.1, which is configured for positioning the first fitness apparatus 1.1 on a floor. Accordingly, the supporting elements of the first fitness apparatus 1.1 are dimensioned such that a user can position his/her feet thereon. The first fitness apparatus 1.1 is connected to a second fitness apparatus 1.2 via an upright 17. The second fitness apparatus has a second housing, wherein the supporting elements of the second fitness apparatus are configured for supporting the forearm or upper arm and/or for being held by hand. Both the first housing 1.1 and also the second housing 1.2 are connected to the upright 17 in a releasable manner, in particular via a quick-release fastener. This also allows the two fitness apparatuses 1.1, 1.2 to be used independently of one another. The upright 17 has a length-adjustment mechanism. This means that the second fitness apparatus can be positioned at different distances from the first fitness apparatus 1.1 by virtue of the length of the upright 17 being altered, and this allows the arrangement to be used by users of different heights.

The second fitness apparatus 1.2 also has a display 19, which is connected to the second housing 1.2 via a stand 18. This display 19 can be used to show information relating to a training session, for example calorie consumption or a time display. The display 19 preferably also has input means, for example via a touch screen, so that a user can also input data.

What is claimed is:

1. A fitness apparatus having a housing, the housing comprising a first supporting element which is configured as a platform for supporting a foot or a part of an arm, and a second supporting element arranged thereon, the first supporting element and the second supporting element being each movable linearly in a first spatial dimension and in a second spatial dimension, the first spatial dimension and the second spatial dimension being located at right angles to one another, wherein the housing has at least one spring, by which a movement of the first supporting element or the second supporting element out of a respective starting position is counteracted by a force, wherein the housing further comprises:

a) a first coupling element, which couples the linear movement of the first supporting element in a first direction of a first of the two spatial dimensions to a linear movement of the second supporting element in a second direction, which opposes the first direction in the first of the two spatial dimensions, the first coupling element comprising:

i) a first gearwheel, which is arranged centrally on a surface area of the housing, and which has an axis of rotation which is at right angles to the first spatial dimension and to the second spatial dimension;

ii) a first rack fastened to the first supporting element and extending in the direction of the first spatial dimension;

iii) a second rack fastened to the second supporting element and extending in the direction of the first spatial dimension;

b) wherein the first rack and the second rack engage with the first gearwheel on opposite sides of the first gearwheel;

c) a second coupling element, the second coupling element comprising:

i) a second gearwheel, which is arranged centrally on the surface area of the housing and which has an axis of rotation which is at right angles to the first spatial dimension and to the second spatial dimension, the second gearwheel being arranged above or beneath the first gearwheel;

ii) a third rack fastened to the first supporting element and extending in the direction of the second spatial dimension;

iii) a fourth rack fastened to the second supporting element and extending in the direction of the second spatial dimension;

d) wherein the third rack and the fourth rack engage with the second gearwheel on opposite sides of the second gearwheel.

2. The fitness apparatus as claimed in claim 1, wherein the first supporting element and the second supporting element are guided in the first spatial dimension or in the second spatial dimension by at least one first linear guide.

3. The fitness apparatus as claimed in claim 2, wherein the at least one first linear guide extends in the first spatial dimension and a carriage is arranged in a movable manner on the at least one first linear guide, and at least one second linear guide extending in the second spatial dimension, and wherein the first supporting element and the second supporting element are arranged in a movable manner on the at least one second linear guide.

4. The fitness apparatus as claimed in claim 1, wherein the at least one spring is configured such that the force thereof, which counteracts a movement of the first supporting element or of the second supporting element out of the starting position acts on the first gearwheel and/or on the second gearwheel.

5. The fitness apparatus as claimed in claim 1, wherein the force of the at least one spring which counteracts a movement of the first supporting element or of the second supporting element out of the starting position is adjustable.

6. The fitness apparatus as claimed in claim 1, wherein the first supporting element and the second supporting element each have a handle, which each extends in a third spatial dimension, which is located at right angles to the first spatial dimension and to the second spatial dimension.

7. The fitness apparatus as claimed in claim 6, wherein the handle has a first part and a second part, and wherein the first part can be displaced linearly relative to the second part in the third spatial dimension, and wherein displacement of the first part relative to the second part takes place counter to a spring force.

8. An arrangement comprising two fitness apparatuses, wherein each fitness apparatus of the two fitness apparatuses include:

a housing, the housing including a first supporting element which is configured as a platform for supporting a foot or a part of an arm, and a second supporting element arranged thereon, the first supporting element and the second supporting element being each movable linearly in a first spatial dimension and in a second spatial dimension, the first spatial dimension and the second spatial dimension being located at right angles to one another, wherein the housing has at least one spring, by which a movement of the first supporting element or the second supporting element out of a respective starting position is counteracted by a force, wherein the housing further comprises:

a) a first coupling element, which couples the linear movement of the first supporting element in a first direction of a first of the two spatial dimensions to a linear movement of the second supporting element in a second direction, which opposes the first direction in the first of the two spatial dimensions, the first coupling element comprising:

i) a first gearwheel, which is arranged centrally on a surface area of the housing, and which has an axis of rotation which is at right angles to the first spatial dimension and to the second spatial dimension;

ii) a first rack fastened to the first supporting element and extending in the direction of the first spatial dimension;

iii) a second rack fastened to the second supporting element and extending in the direction of the first spatial dimension;

b) wherein the first rack and the second rack engage with the first gearwheel on opposite sides of the first gearwheel;

c) a second coupling element, the second coupling element comprising:

i) a second gearwheel, which is arranged centrally on the surface area of the housing and which has an axis of rotation which is at right angles to the first spatial dimension and to the second spatial dimension, the second gearwheel being arranged above or beneath the first gearwheel;

ii) a third rack fastened to the first supporting element and extending in the direction of the second spatial dimension;

iii) a fourth rack fastened to the second supporting element and extending in the direction of the second spatial dimension;

d) wherein the third rack and the fourth rack engage with the second gearwheel on opposite sides of the second gearwheel;

wherein the housing of a first of the two fitness apparatuses is configured for placing on a floor and the first supporting element and the second supporting element of the housing of the first of the two fitness apparatuses are suitable for having feet placed in position on them, wherein the first spatial dimension and also the second spatial dimension are oriented essentially parallel to the floor, and wherein a second of the two fitness apparatuses is connected in a releasable manner to the first of the two fitness apparatuses, and is spaced apart therefrom by a first distance, via an upright, which extends essentially in a third spatial dimension, which is located at right angles to the first spatial dimension and to the second spatial dimension.

* * * * *